US005476218A

United States Patent [19]

Reisman

[11] Patent Number: 5,476,218

[45] Date of Patent: Dec. 19, 1995

[54] CARDBOARD BOX HAVING A SMOOTH FLAT BOTTOM

[76] Inventor: Morris Reisman, 17801 Cardinal Cir., Villa Park, Calif. 92667

[21] Appl. No.: 358,395

[22] Filed: Dec. 19, 1994

[51] Int. Cl.[6] ..... B65D 5/26; B65D 5/66

[52] U.S. Cl. ..... 229/123; 206/425; 229/147; 229/164; 229/178; 229/194

[58] Field of Search ..... 229/123, 147, 229/151, 164, 178, 193, 194, 195; 206/425

[56] References Cited

U.S. PATENT DOCUMENTS

| | | | |
|---|---|---|---|
| 3,014,633 | 12/1961 | Tarmina | 229/178 |
| 3,301,461 | 1/1967 | Kroeschell | 229/178 |
| 3,843,040 | 10/1974 | Locke | 229/193 |
| 3,854,651 | 12/1974 | Osborne | 229/178 |
| 3,889,868 | 6/1975 | Bruckner et al. | 229/178 |
| 3,933,300 | 1/1976 | Dempster | 229/194 |
| 3,998,379 | 12/1976 | Myers et al. | 229/178 |
| 4,265,391 | 5/1981 | Zornes et al. | 229/194 |
| 4,511,079 | 4/1985 | Lopez | 229/178 |
| 5,007,580 | 4/1991 | Morrison et al. | 229/193 |
| 5,236,122 | 8/1993 | Ballard | 229/178 |

*Primary Examiner*—Gary E. Elkins
*Attorney, Agent, or Firm*—Edgar W. Averill, Jr.

[57] ABSTRACT

A cardboard box for storing and easily removing cards which box has a smooth flat bottom. The box has a bottom panel to which front and back panels are hingedly affixed. The back panel has a pair of end flaps, each of which have flaps extending from them. The front panel has a pair of end flaps and the top panel is hinged to the back panel and an outer front panel is also hinged thereto. When the box is folded the end flaps of the back panel fold around so that the bottom panel has an upper surface that is not interrupted by any flaps.

5 Claims, 2 Drawing Sheets

CARDBOARD BOX HAVING A SMOOTH FLAT BOTTOM

BACKGROUND OF THE INVENTION

The field of the invention is cardboard boxes and the invention relates more particularly to cardboard boxes more commonly used to hold baseball cards or more broadly sport cards.

People who trade baseball cards and other sports cards are very concerned about the condition of the cards. It is important that the bottom of the cards remain undamaged since any damaged edge will reduce the value of the card. Most baseball card boxes have a cardboard flap on the bottom thereof which can conceivably cause some damage to the bottom of the cards.

Boxes with smooth bottoms have been used for baseball trading cards but the design commonly used can permit the front or back side of the box to open outwardly since the front and the back are held in the side by half flaps. This is very detrimental to the careful card collector and a design which prohibits the front and back sides from moving outwardly is needed.

SUMMARY OF THE INVENTION

It is an object of the present invention to provide a cardboard box for storing sports cards which box has a smooth flat bottom which will not damage the bottoms of the cards stored therein.

The present invention is for a cardboard box having a bottom panel having an inner front panel folded upwardly along a front edge thereof. A back panel is folded upwardly along a back edge of the bottom panel and the inner front panel has a pair of inner front panel flaps, each of which have an upwardly extending tab and the bottom panel has a pair of opposed bottom notches at opposing ends thereof. A top panel is folded inwardly from the back panel and an outer front panel folds downwardly from the top panel. The outer front panel has two end folds with a front panel tab at each end fold thereof and said top panel has a pair of opposed top notches at opposing ends thereof. A pair of opposed outer end flaps fold inwardly from the back panel and each of the end flaps in turn have a pair of opposed flaps, namely an inner end flap and an inner side flap. The inner end flap is folded over the outer end flap and captures the inner side flaps and the inner front panel flaps. A flap notch is located at a fold between the inner end flap and the outer end flap and the flap notch captures the upwardly extending tab of the inner front panel flap. The outer end flaps removably hold the front panel tabs of the outer front panel which provides a box having a smooth bottom which can hold many sports cards without any possible damage to the bottom thereof.

DESCRIPTION OF THE PREFERRED EMBODIMENTS

Figure 1:
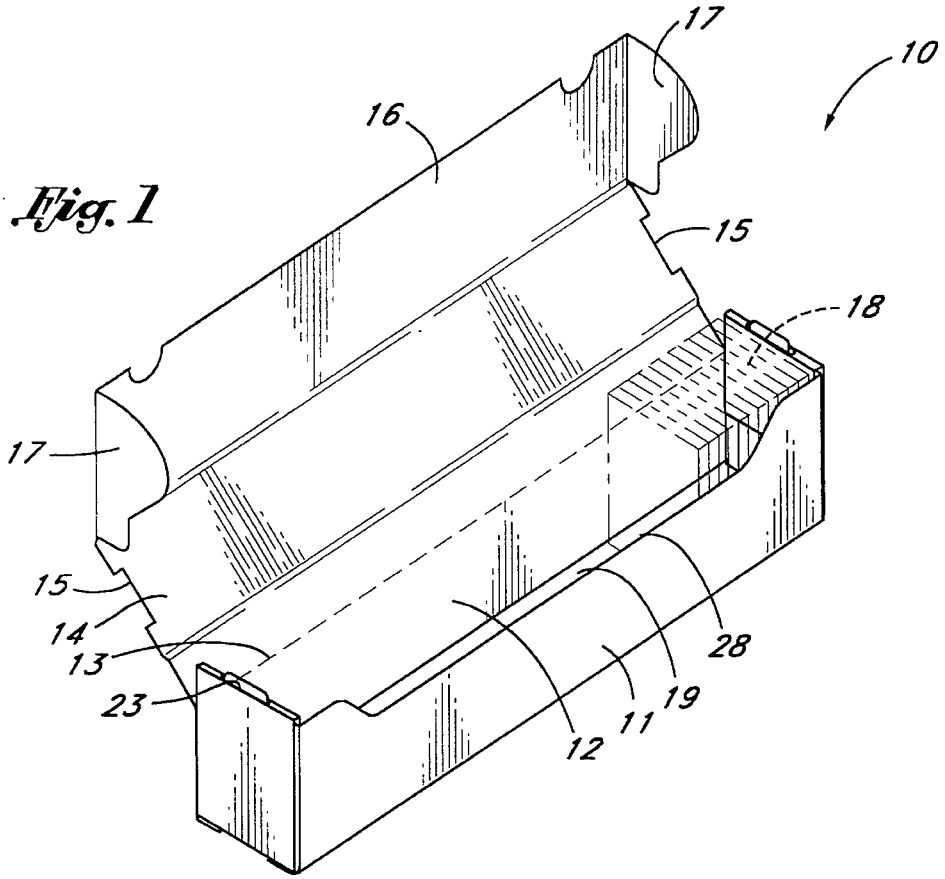
FIG. 1 is a perspective view of the cardboard box of the present invention showing the cover in an open position.

A cardboard box having a smooth flat bottom is shown in perspective view in FIG. 10 and indicated generally by reference character 10. Box 10 has an inner front panel 11 a back panel 12 which has a rearwardly folding crease 13. A top panel 14 has a pair of top notches 15 at the edges thereof and hingedly holds an outer front panel 16 which in turn has front panel tabs 17. Baseball cards 18 are shown in phantom view and the bottom of the cards rest on a bottom panel 19 which as described below has a smooth bottom.

Figure 2:
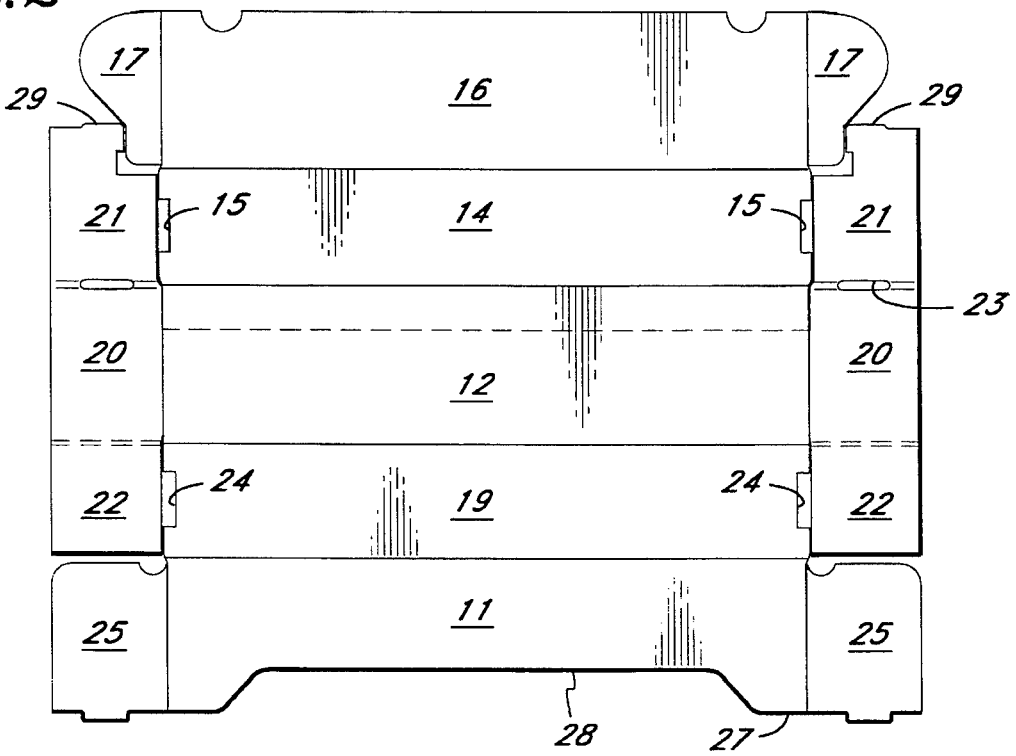
FIG. 2 is a plan view of the unfolded box of FIG. 1.

The various parts of the box of FIG. 1 are shown in an unfolded configuration in FIG. 2 where several additional features are evident. Back panel 12 has a pair of outer end flaps 20 each of which have an inner end flap 21 and an inner side flap 22. A flap notch 23 is positioned between the inner end flap 21 and the outer end flap 20. A pair of bottom notches 24 are visible at each end of bottom panel 19. Inner front panel 11 has inner front panel flaps 25 and inner front flap 25 has an upwardly extending tab 26. The top edge 27 of inner front panel 11 has downward recess 28.

Figures 3, 4, 5, 6, 7, 8, 9:
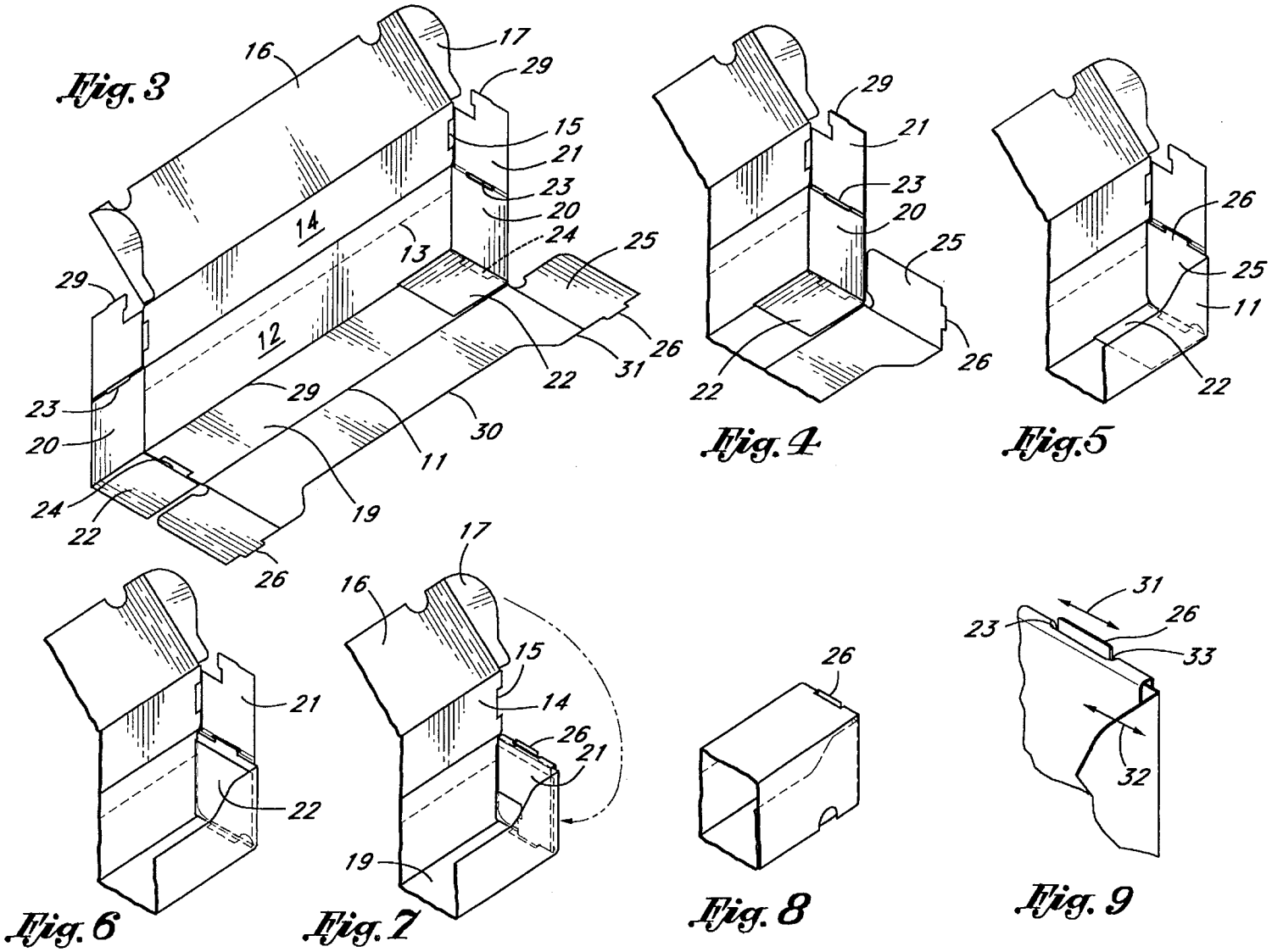
FIG. 3 is a partially folded view.
FIG. 4 is a view of the right side of the box of FIG. 3 in a further folded position.
FIG. 5 is a perspective view of the right side of the box of FIG. 4 in a further folded condition.
FIG. 6 is perspective view of the right end of the box of FIG. 5 in a further folded condition.
FIG. 7 is a perspective view of the right end of the box of FIG. 6 in a further folded condition.
FIG. 8 is a perspective view of the right end of the box of FIG. 7 in a fully folded position.
FIG. 9 is a perspective enlarged view of the top of the right end of the box of FIG. 7.

The folding of the box is shown in FIGS. 3 through 8 and in FIG. 3 the back panel 12 has been folded upwardly from the bottom panel 19 along the back edge 29 of bottom panel 19. The outer end flap 20 is folded forwardly and the inner side flap 22 is shown temporarily against the bottom panel 19. The next step is shown in FIG. 4 where the inner front panel flap 25 has been folded upwardly. Next in FIG. 5 the inner front panel 11 has been folded upwardly and the inner front panel flap 25 rests against outer end flap 20. Next in FIG. 6 the inner side flap 22 is folded upwardly and then in FIG. 7 the inner end flap 21 is folded over against the inner side flap 22 and the upwardly extending tab 26 is captured in flap notch 23 and the downwardly extending tab 29 at the extremity of the inner end flap 21 fits into bottom notch 24 to secure the end assembly in a fixed position as indicated in FIG. 7. Lastly, the top panel 14 and the outer front panel are folded around as shown in FIG. 8 and the front panel tab 17 is passed between the inner front panel flap 25 and the outer end flap 20 to securely close the box. The resulting box as shown best in FIGS. 6 and 7 has a completely smooth bottom 19 so that the cards can be safely kept therein. The smooth bottom does not require a separate part or insert.

Another important feature of the box of the present invention is the secure manner in which the front panel 11 is held upright. Since baseball cards are relatively heavy, they can push against a conventional box and force the inner front panel downwardly. Typically, the inner front panel flaps 25 are relatively short and can pull out from their captured position allowing the front edge to open forwardly permitting the contents to fall out. This problem has been solved into two ways. First, the inner front panel flap 24 is wide enough so that it abuts back panel 12 as shown best in FIG. 5. In addition, the upwardly extending tab 26 passes substantially through flap notch 23 as shown best in FIG. 9 of the drawings. Furthermore the upwardly extending tab 26 is not as wide as flap notch 23. This permits the box to expand slightly as indicated by the arrows 31 and 32 in FIG. 9. The front panel 11 is prevented from pulling out because the upwardly extending tab 26 abuts the forward edge 33 of notch 23. Thus, some forward movement is permitted, but the front panel is locked from opening by this design. In addition, the top notch 15 is positioned as shown in FIGS. 7 and 8 to permit the upwardly extending tab 26 to extend past the top of the box.

The box of the present invention provides an attractive easily assembled box which may safely hold a plurality of trading cards. The design of the box of the present invention is further improved by the combination of the downward recess 30 and the rearwardly folding crease 13 permits the user to grasp the cards from both directions when the box is fully opened as shown in FIG. 1.

The present embodiments of this invention are thus to be considered in all respects as illustrative and not restrictive; the scope of the invention being indicated by the appended claims rather than by the foregoing description. All changes which come within the meaning and range of equivalency of the claims are intended to be embraced therein.

I claim:

1. A cardboard box for storing and easily removing cards stored therein, said box having a smooth flat bottom which will not damage bottoms of cards stored therein, said box comprising;

a bottom panel having an inner front panel folded upwardly along a front edge and a back panel folded upwardly along a back edge thereof, said inner front panel having a pair of inner front panel flaps, each of said panel flaps with an upwardly extending tab and said bottom panel having a pair of opposed bottom slots at opposing ends of the bottom panel and said back panel having a top edge;

a top panel folded inwardly from the back panel and an outer front panel folded downwardly from the top panel, said outer front panel having two end folds with a front panel tab at each end fold thereof; and a pair of opposed outer end flaps folded inwardly from said back panel, each of said outer end flaps having a pair of opposed flaps, namely an inner end flap and an inner side flap, said inner end flap having a downwardly extending tab snapped into one of said bottom slots and said outer end flap capturing the inner side flap and the inner front panel flaps, and a flap notch located at a fold between the inner end flap and the outer end flap, said flap notch capturing the upwardly extending tab of said inner front panel flap and each outer end flap removably holding the front panel tabs of the outer front panel whereby a box having a smooth bottom results.

2. The cardboard box of claim 1 further including a downward recess formed along a top edge of said inner front panel.

3. The cardboard box of claim 2 further including a rearwardly folding crease near the top edge of the back panel to facilitate the removal of cards stored therein.

4. The cardboard box of claim 1 further including a pair of opposed top notches at opposing ends of said top panel and positioned so that said upwardly extending tabs may extends therethrough.

5. The cardboard box of claim 1 wherein said flap notch is wider than said upwardly extending tab to permit the inner front panel to move inwardly and outwardly as the upwardly extending tab moves along said flap notch.

* * * * *